US006485344B2

(12) United States Patent
Arias

(10) Patent No.: US 6,485,344 B2
(45) Date of Patent: Nov. 26, 2002

(54) COLLAPSIBLE FLOTATION DEVICE

(75) Inventor: David A. Arias, Virginia Beach, VA (US)

(73) Assignee: Gray Matter Holdings, LLC, Baltimore, MD (US)

( * ) Notice: Subject to any disclaimer, the term of this patent is extended or adjusted under 35 U.S.C. 154(b) by 0 days.

(21) Appl. No.: 09/772,739

(22) Filed: Jan. 30, 2001

(65) Prior Publication Data

US 2002/0102889 A1 Aug. 1, 2002

Related U.S. Application Data

(60) Provisional application No. 60/238,988, filed on Oct. 10, 2000.

(51) Int. Cl.[7] ..... B63C 9/08
(52) U.S. Cl. ..... 441/131
(58) Field of Search ..... 5/417, 419, 420; 114/345; 441/40, 43, 80, 81, 125, 129, 130, 131, 136

(56) References Cited

U.S. PATENT DOCUMENTS

| | | | | |
|---|---|---|---|---|
| 722,801 A | | 3/1903 | Bourne, Jr. | |
| 1,190,743 A | * | 7/1916 | Fageol | 441/131 |
| 1,479,903 A | | 1/1924 | Erland | |
| 1,960,474 A | * | 5/1934 | Browne | 441/129 |
| 2,119,023 A | | 5/1938 | Pickard | |
| 2,173,963 A | * | 9/1939 | Eubank | 441/131 |
| 2,190,566 A | | 2/1940 | Julian | |
| 2,344,010 A | | 3/1944 | Walsh | |
| 2,357,789 A | | 9/1944 | Levy | |
| 2,420,344 A | | 5/1947 | Alexander | |
| 2,442,105 A | | 5/1948 | Vacheron | |
| 2,637,861 A | | 5/1953 | Kethledge | |
| 2,731,997 A | | 1/1956 | Muth et al. | |
| 2,803,291 A | | 8/1957 | Meyer | |
| 2,870,464 A | | 1/1959 | Lalick | |
| 3,052,895 A | | 9/1962 | Lo Vico | |
| 3,336,610 A | | 8/1967 | Geddings | |
| 3,602,930 A | * | 9/1971 | Channon | 441/65 |
| 3,775,782 A | * | 12/1973 | Rice et al. | 5/82 |
| 3,862,876 A | | 1/1975 | Graves | |
| 3,960,161 A | | 6/1976 | Norman | |
| 3,990,463 A | | 11/1976 | Norman | |
| 4,097,944 A | | 7/1978 | Yulish | |
| 4,200,942 A | | 5/1980 | Case | |
| 4,231,125 A | | 11/1980 | Tittl | |
| D261,464 S | | 10/1981 | Smith | |
| 4,296,788 A | | 10/1981 | Slater | |
| 4,478,587 A | * | 10/1984 | Mackal | 441/41 |

(List continued on next page.)

FOREIGN PATENT DOCUMENTS

EP 0 974 293 A2 1/2000

*Primary Examiner*—S. Joseph Morano
*Assistant Examiner*—Andrew Wright
(74) *Attorney, Agent, or Firm*—Cooley Godward LLP

(57) ABSTRACT

A collapsible flotation device has an uncollapsed configuration and a collapsed configuration. The device includes a spring which is forced to coil in upon itself by folding to achieve the collapsed configuration of the device and which is biased towards the uncoiled configuration. The spring is located along the perimeter of the device in a pocket formed along the perimeter of a panel of flexible material or on the external perimeter of the device. Also located within the pocket are one or more inflation chambers which are inflated to provide buoyancy. Additional or alternate pockets which include inflatable chambers may be located in the central portion of the flexible panel.

25 Claims, 5 Drawing Sheets

U.S. PATENT DOCUMENTS 4,512,049 A 4/1985 Henry
4,561,480 A 12/1985 Underwood et al.
4,576,375 A * 3/1986 Roberts ..... 472/129
4,709,430 A 12/1987 Nicoll
4,766,918 A * 8/1988 Oderkirk ..... 135/96
4,815,784 A 3/1989 Zheng
4,825,892 A 5/1989 Norman
4,858,634 A 8/1989 McLeese
4,942,838 A * 7/1990 Boyer et al. ..... 114/345
4,946,067 A * 8/1990 Kelsall ..... 222/5
4,951,333 A 8/1990 Kaiser et al.
4,976,642 A * 12/1990 Wilkie ..... 441/131
5,024,262 A 6/1991 Huang
5,038,812 A 8/1991 Norman
5,056,172 A 10/1991 Kaiser et al.
5,059,463 A 10/1991 Peters
5,070,807 A * 12/1991 Lewis ..... 114/361
D325,489 S 4/1992 Pratt
5,116,273 A 5/1992 Chan
5,163,192 A 11/1992 Watson
5,163,461 A 11/1992 Ivanovich et al.
5,206,964 A 5/1993 Wilson, Sr.
5,213,147 A 5/1993 Zheng
5,261,131 A 11/1993 Kilby
5,299,331 A 4/1994 Badillo
D349,593 S 8/1994 Hensley
5,334,067 A * 8/1994 Henry et al. ..... 441/131
5,345,627 A 9/1994 Cammarata
5,385,518 A * 1/1995 Turner ..... 482/23
5,396,917 A 3/1995 Hazinski et al.
5,430,980 A 7/1995 Ferrier
5,433,433 A 7/1995 Armell
5,435,025 A 7/1995 Gerard et al.
5,454,643 A 10/1995 Sullivan
5,467,794 A 11/1995 Zheng
D366,177 S 1/1996 Dean
5,520,561 A * 5/1996 Langenohl ..... 441/129
5,533,653 A 7/1996 Kaufman
5,560,385 A 10/1996 Zheng
5,571,036 A * 11/1996 Hannigan ..... 441/129
5,579,799 A 12/1996 Zheng
5,592,961 A 1/1997 Chin
5,618,110 A 4/1997 Sullivan
5,618,246 A 4/1997 Zheng
RE35,571 E 7/1997 McLeese
5,644,807 A 7/1997 Battistella
5,688,052 A 11/1997 Compton
5,693,398 A 12/1997 Granger
D389,362 S 1/1998 Boulatian
5,718,612 A * 2/1998 Elsholz ..... 441/38
5,729,846 A 3/1998 Sullivan
5,730,529 A 3/1998 Fritz et al.
5,810,695 A * 9/1998 Sass ..... 441/37
D400,749 S 11/1998 Bechtold, Jr.
5,885,123 A * 3/1999 Clifford ..... 441/129
5,976,023 A 11/1999 Cho
6,030,300 A 2/2000 Zheng
D425,357 S 5/2000 Waring
D426,415 S 6/2000 Le Gette et al.
6,073,283 A 6/2000 Zheng
6,170,100 B1 1/2001 Le Gette et al.
6,192,635 B1 2/2001 Zheng
6,223,673 B1 * 5/2001 Mears et al. ..... 114/364
6,276,979 B1 * 8/2001 Saltel et al. ..... 441/132
D447,661 S 9/2001 Le Gette et al.
D449,193 S 10/2001 Le Gette et al.

* cited by examiner

COLLAPSIBLE FLOTATION DEVICE

CROSS REFERENCE TO RELATED APPLICATION

The present application claims priority from U.S. Provisional Application Ser. No. 60/238,988, filed Oct. 10, 2000.

BACKGROUND OF THE INVENTION

1. Field of the Invention

The present invention relates to inflatable flotation devices. In particular, the present invention relates to inflatable flotation devices which are collapsible through use of a spring mechanism.

2. Description of the Related Art

Inflatable flotation devices are well known in the form of floats, rafts, lifeboats, life preservers and other like devices. Previously known devices generally maintain their shape through air pressure alone and generally collapse when deflated.

In one of many examples, U.S. Pat. No. 3,775,782 issued to Rice et al. describes an inflatable rescue raft. When deflated, the raft can be rolled into a compact size.

Also well known in the art are collapsible items which are collapsible through the use of a collapsible metal or plastic spring. U.S. Pat. No. 4,815,784 shows an automobile sun shade which uses these collapsible springs. The springs are also used in children's play structures (U.S. Pat. Nos. 5,618,246 and 5,560,385) and tent-like shade structures (U.S. Pat. Nos. 5,579,799 and 5,467,794).

The collapsible springs are typically retained or held within fabric sleeves provided along the edges of a piece of fabric or other panel. The collapsible springs may be provided as one continuous loop, or may be a strip or strips of material connected at the ends to form a continuous loop. These collapsible springs are usually formed of flexible coilable steel, although other materials such as plastics are also used. The collapsible springs are usually made of a material which is relatively strong and yet is flexible to a sufficient degree to allow it to be coiled. Thus, each collapsible spring is capable of assuming two configurations, a normal uncoiled or expanded configuration, and a coiled or collapsed configuration in which the spring is collapsed into a size which is much smaller than its open configuration. The springs may be retained within the respective fabric sleeves without being connected thereto. Alternatively, the sleeves may be mechanically fastened, stitched, fused, or glued to the springs to retain them in position.

SUMMARY OF THE DISCLOSURE

A collapsible flotation device is described which includes a coilable spring and a flexible panel. Along the outer edge of the flexible panel is a perimeter pocket into which the coilable spring and at least one inflatable chamber are placed. The coilable spring can be made from steel which has been treated such that it is resistant to water damage or the coilable spring can be made from a waterproof material. The flexible panel can be made from any material which is appropriate for use in the water such as nylon. Alternatively, the flexible panel can be constructed from multiple materials. For example, the perimeter pocket can be made from nylon while the central portion can be made from mesh material. The inflatable chambers are made from any appropriate material but are preferably puncture resistant and each chamber includes a means for inflating and deflating the chamber such as a valve. The flotation device can also include a pillow section to provide buoyant support for a user's head. This pillow section would also include an inflatable chamber to form the pillow. In addition to or instead of the perimeter pockets, the central portion of the flexible panel may include pockets into which inflatable chambers may be placed. Although the spring is normally placed within the perimeter pocket of the flexible panel, it would be possible to mechanically attach the coilable spring to the outer edge of the flexible panel.

It is therefore an object of the present invention to provide a collapsible flotation device.

It is another object of the present invention to provide a collapsible flotation device which is easily collapsed and extended to full size through a mechanical means.

It is yet another object of the present invention to provide a collapsible flotation device which is easily collapsed and extended to full size through the use of a spring.

It is yet a further object of the present invention to provide a collapsible flotation device which requires minimal force to twist and fold into the collapsed configuration.

Finally, it is an object of the present invention to accomplish the foregoing objectives in a simple and cost effective manner.

DETAILED DESCRIPTION OF THE PREFERRED EMBODIMENTS

Figure 1:
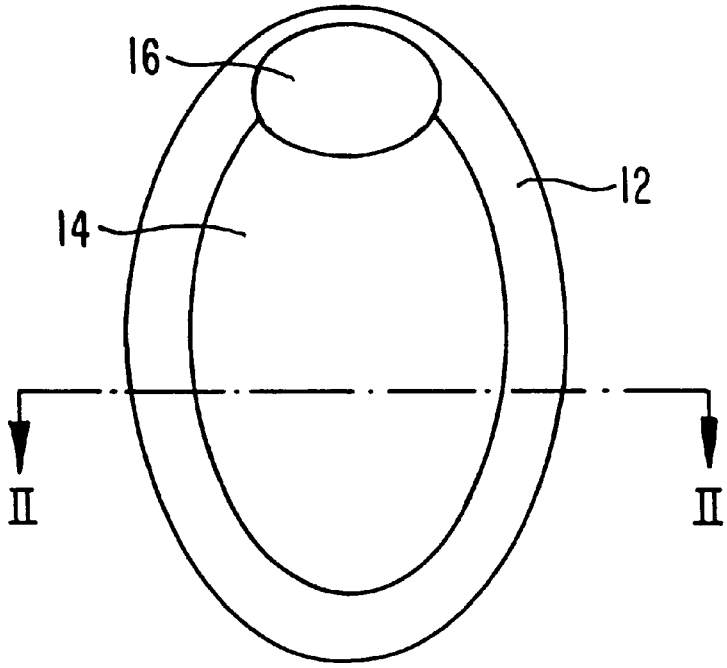
FIG. 1 is a top view of the preferred embodiment of the present invention.

The following detailed description is of the best presently contemplated modes of carrying out the invention. This description is not to be taken in a limiting sense, but is made merely for the purpose of illustrating general principles of embodiments of the invention.

The present invention provides a collapsible flotation device. The device includes a coilable metal or plastic spring. The coilable spring can be made from other materials, however, it is important that the coilable spring be made from a material that is strong and flexible. The spring must be coilable such that it folds on top of itself to become more compact. In its uncoiled state, the coilable spring can be round or oval or any shape satisfactory for use as a flotation device. Because it is to be used in water, the coilable spring is preferably either manufactured from a waterproof material or coated to protect any material which is not waterproof. The coilable spring can be a single continuous element or can include a joining means, such as a sleeve, for joining the ends of one or more spring elements together. The coilable spring can be of any appropriate shape and dimension. The coilable spring also has memory such that is biased to return to its uncoiled configuration when not held in the coiled configuration.

Stretched across the coilable spring is a flexible panel of material. The flexible panel can be one continuous piece or can be made up of several different types of material. In a preferred embodiment, the center portion of the flexible panel is mesh to allow water to flow through while the perimeter edges are nylon or polyester. At the edges of the flotation device, the material is a double thickness, forming a pocket around the perimeter of the flotation device. In this pocket are one or more inflatable chambers. One inflatable chamber may surround the entire perimeter of the flotation device or it may be divided into two or more inflatable chambers with each inflatable chamber having a means for inflating and deflating the inflatable chamber. In a preferred embodiment, one inflatable chamber is specifically designed to accommodate the user's head. In this embodiment, the pocket formed by the material is wider along a small portion of the perimeter of the flotation device to allow for a wider inflatable chamber. This will prevent the user's head from sinking below the rest of the user's body. The size of the inflatable chamber can vary significantly and need only be as wide as necessary to support the user's body weight. A preferred embodiment includes an inflatable chamber which is 3 inches in diameter when inflated. The inflatable chamber can be made from any appropriate float material but is preferably resistant to punctures. The coilable spring may also be located within the perimeter pocket. If one inflatable chamber is selected, the coilable spring can be placed inside or outside the inflatable chamber. If multiple inflatable chambers are used, the coilable spring will be outside the inflatable chambers. Alternatively, the coilable spring may be located outside the perimeter pocket along the outer edge of the flotation device. The coilable spring may be attached to the flexible panel through mechanical means such as fastening, stitching, fusing, or gluing.

Figure 2:
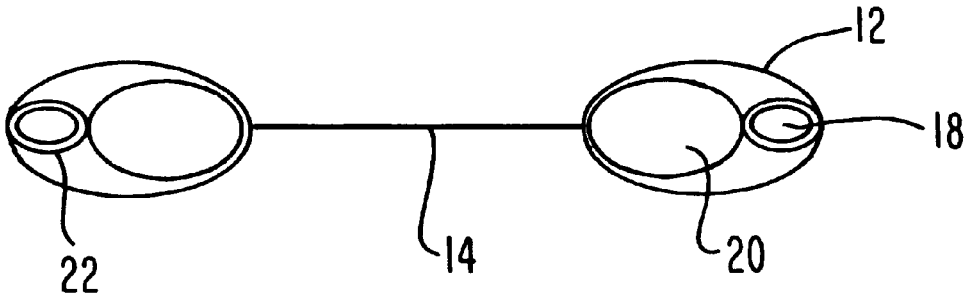
FIG. 2 is a cross sectional view of the preferred embodiment of the present invention taken along line II—II of FIG. 1.
Figure 3:
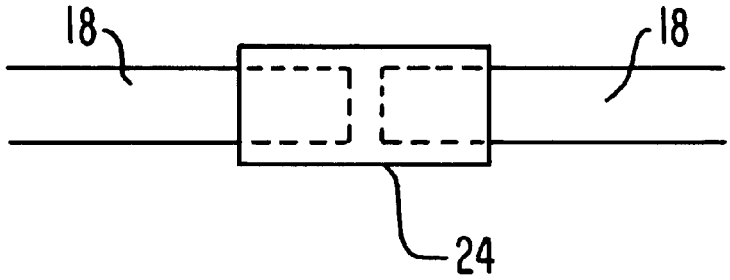
FIG. 3 is a view of a joining method as used in one embodiment of the present invention.

A preferred embodiment of the flotation device is shown in FIGS. 1 and 2 in its expanded configuration. The perimeter pocket 12 portion of the flexible panel is nylon while the central portion 14 of the flexible panel is made from a mesh material. The pillow 16 is part of the perimeter pocket 12 as it includes a double layer of fabric to accept an inflatable chamber 20 between the layers of fabric. In this particular embodiment, there are two inflatable chambers 20 in the perimeter pocket of the flotation device and one in the pillow 16, each of which includes a means for inflating the inflatable chamber 20. The inflation means is a valve on the underside of the flotation device. The inflatable chambers 20 in the perimeter pocket of the flotation device expand to approximately a 3-inch diameter when inflated. The coilable spring 18 is made from flexible, collapsible steel and is coated with a layer of PVC 22 to protect the coilable spring 18 from corroding and rusting due to contact with water during normal use of the flotation device. The coilable spring 18 also has memory such that will open to its uncoiled configuration when not held in the coiled configuration. The coilable spring 18 can be a single unitary element or can include sleeves 24 for joining the ends of one or more strips as shown in FIG. 3 in which the ends of the coilable spring 18 within the sleeve 24 are shown in dashed lines for clarification.

Figure 4:
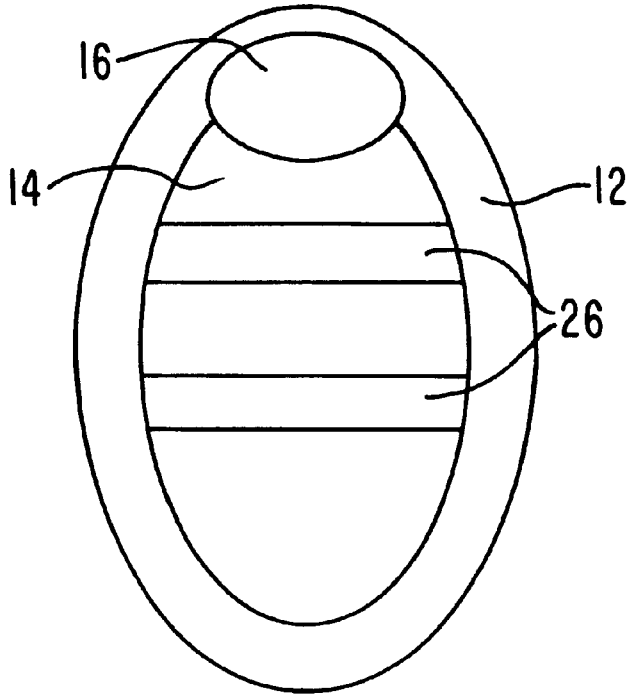
FIG. 4 is a top view of an alternate embodiment of the present invention.
Figure 5:
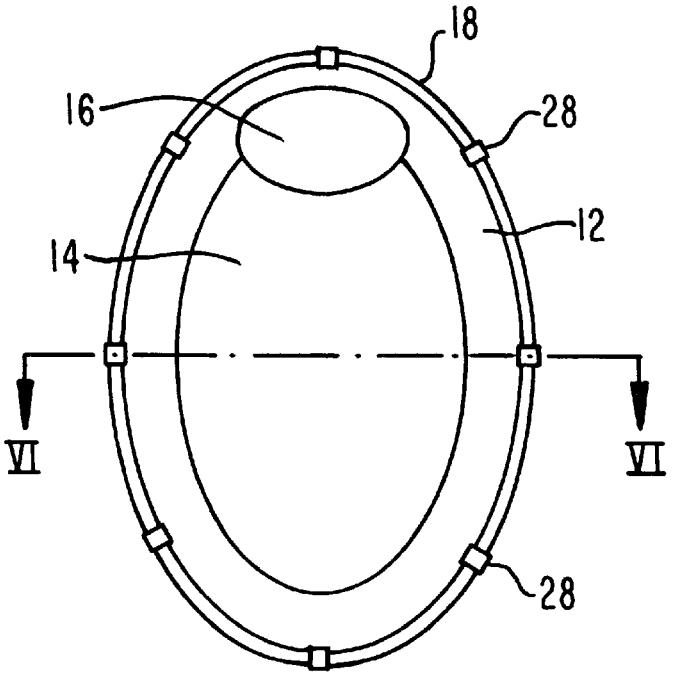
FIG. 5 is a top view of another alternate embodiment of the present invention.
Figure 6:
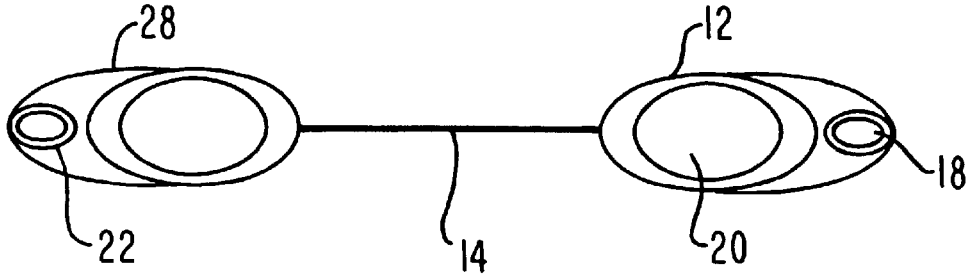
FIG. 6 is a cross section view of the alternate embodiment of the present invention across line VI—VI of FIG. 5.
Figure 7:
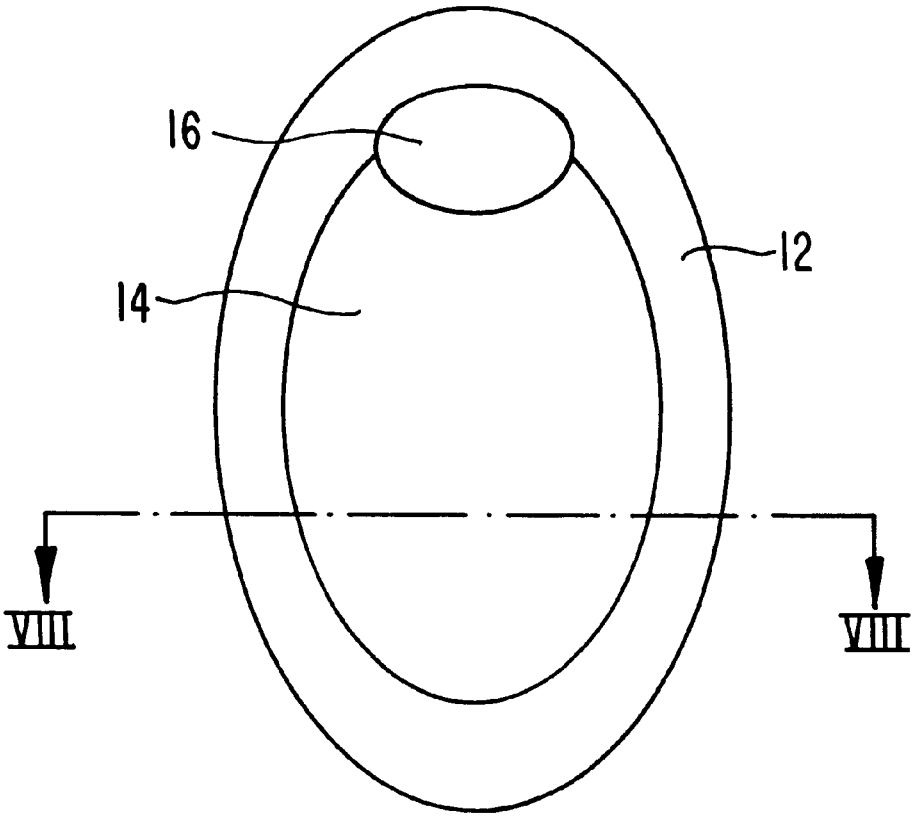
FIG. 7 is a top view of an alternative embodiment of the present invention.
Figure 8:
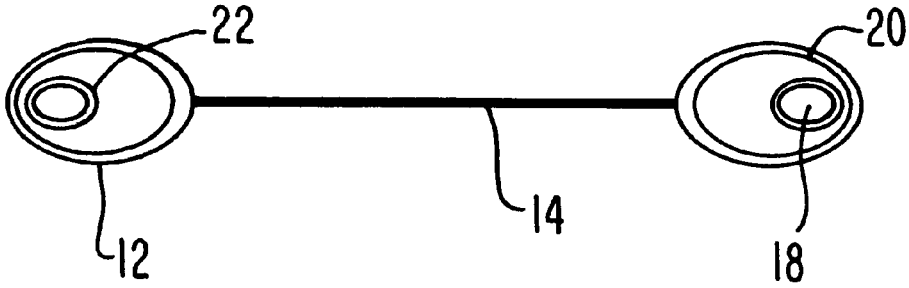
FIG. 8 is a cross sectional view of the embodiment of the present invention, taken along line VIII—VIII of FIG. 7.
Figure 9:
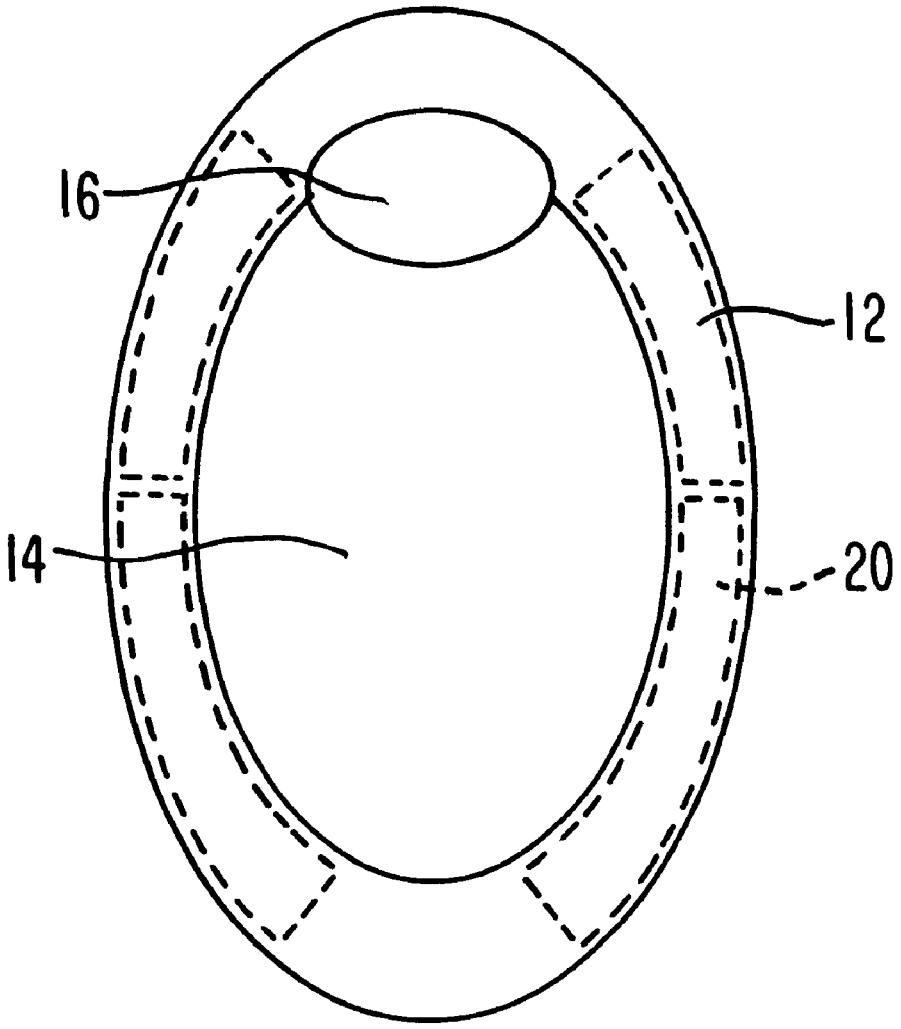
FIG. 9 is a plan view of another embodiment of the present invention.

Alternatively or in addition to the perimeter inflatable chambers, the device can include inflatable chambers 26 which cross the panel as shown in FIG. 4. FIGS. 5 and 6 show a further alternate embodiment of the present invention in which the coilable spring 18 is attached to the external perimeter of the pocket portion 12 of the flexible panel through the use of a mechanical means. In this particular embodiment, several loops 28 are used to attach the coilable spring 18 to the pocket portion 12 of the flexible panel.

While the description above refers to particular embodiments of the present invention, it will be understood that many modifications may be made without departing from the spirit thereof The accompanying claims are intended to cover such modifications as would fall within the true scope and spirit of the present invention.

What is claimed is:

1. A collapsible device, comprising:

a panel having a central portion and a perimeter sleeve, said panel being permeable to a liquid;

a spring coupled substantially around the perimeter of the panel and moveable between a coiled and an uncoiled configuration, said spring being coiled while in a collapsed configuration and being uncoiled while in an expanded configuration; and an inflatable bladder disposed circumferentially about, and being encapsulated within, at least a portion of said perimeter sleeve, said inflatable bladder configured to support a body weight of a user disposed on the panel.

2. A collapsible floatation device, comprising:

a panel having a central portion and a perimeter portion;

a coilable spring coupled substantially around the perimeter of the panel, said spring being coiled while in a collapsed configuration and being uncoiled while in an expanded configuration; and an inflatable bladder disposed circumferentially about, and being coupled to, the panel and configured to support a body weight of a user disposed on the panel.

3. The collapsible floatation device of claim 2, wherein said inflatable bladder is encapsulated within a perimeter sleeve defined by said perimeter portion.

4. The collapsible floatation device of claim 3, wherein said coilable spring is disposed within at least a portion of said perimeter sleeve.

5. The collapsible floatation device of claim 3, wherein said coilable spring is disposed within at least a portion of said inflatable bladder.

6. The collapsible floatation device of claim 2, wherein said coilable spring is coupled to said perimeter portion.

7. The collapsible floatation device of claim 2, further comprising:

a sleeve extending through said central portion; and a second inflatable bladder disposed within at least a portion of said sleeve extending through said central portion.

8. The collapsible floatation device of claim 2, said inflatable bladder being a first inflatable bladder, further comprising:

a pillow section configured to encapsulate a second inflatable bladder.

9. A collapsible device, comprising:

a panel having a central portion and a perimeter sleeve;

a coilable spring coupled substantially around the perimeter of the panel, said spring being coiled while in a collapsed configuration and being uncoiled while in an expanded configuration; and an inflatable bladder disposed circumferentially about, and being encapsulated within, at least a portion of said perimeter sleeve.

10. The collapsible device of claim 9, wherein said spring is moveable between a coiled configuration and an uncoiled configuration.

11. The collapsible device of claim 9, wherein said inflatable bladder is configured to support the body weight of a user.

12. The collapsible device of claim 9, wherein said coilable spring is disposed within at least a portion of said perimeter sleeve.

13. The collapsible device of claim 9, wherein said coilable spring is disposed within at least a portion of said inflatable bladder.

14. The collapsible device of claim 9, wherein said coilable spring is coupled outside of said perimeter sleeve and outside of a perimeter of the panel.

15. The collapsible device of claim 9, further comprising:

a pillow section configured to encapsulate at least a portion of said inflatable bladder.

16. The collapsible device of claim 9, said inflatable bladder being a first inflatable bladder, further comprising:

a pillow section configured to encapsulate a second inflatable bladder.

17. The collapsible device of claim 9, wherein said panel is configured to allow water to flow through said central portion.

18. A collapsible device, comprising:

a panel having a central portion and a perimeter sleeve;

a coilable spring coupled substantially around the perimeter of said panel, said spring being coiled while in a collapsed configuration and being uncoiled while in an expanded configuration; and a plurality of inflatable bladders disposed circumferentially about, and being encapsulated within, at least a portion of said perimeter sleeve, the plurality of inflatable bladders include a first inflatable bladder and a second inflatable bladder being disposed on opposite sides of the panel.

19. The collapsible device of claim 18, wherein said coilable spring is disposed within at least a portion of said perimeter sleeve.

20. The collapsible device of claim 18, wherein said coilable spring is coupled outside of said perimeter sleeve and outside of a perimeter of said panel.

21. The collapsible device of claim 18, further comprising:

a pillow section configured to encapsulate one of said plurality of inflatable bladders.

22. A device, comprising:

a panel having a central portion and a perimeter sleeve;

a spring moveable between a coiled configuration and an uncoiled configuration, said spring disposed within at least a portion of said perimeter sleeve and coupled substantially around the perimeter of said panel such that said panel is collapsed when said spring is in the coiled configuration and said panel is expanded when said spring is in the uncoiled configuration; and an inflatable bladder disposed circumferentially about, and extending substantially throughout, said perimeter sleeve.

23. A device, comprising:

a spring configured to form a closed loop, the spring being moveable between a coiled configuration when the spring is collapsed and an uncoiled configuration when the spring is expanded, the spring defining an interior area within at least a portion of the closed loop when the spring is in the uncoiled configuration; and an inflatable bladder coupled to said spring and being disposed circumferentially within said interior area.

24. The device of claim 23, said inflatable bladder defining a second interior area, further comprising:

a panel coupled within said second interior area.

25. The device of claim 24, wherein said panel is permeable to a liquid.

* * * * *